US006880707B2

(12) United States Patent
Rosello

(10) Patent No.: US 6,880,707 B2
(45) Date of Patent: Apr. 19, 2005

(54) DOCUMENT HANDLING APPARATUS AND METHOD

(75) Inventor: Jaime Sallen Rosello, Binefar (ES)

(73) Assignee: Sallen Electronica, Binefar (ES)

( * ) Notice: Subject to any disclaimer, the term of this patent is extended or adjusted under 35 U.S.C. 154(b) by 115 days.

(21) Appl. No.: 10/181,373

(22) PCT Filed: Feb. 16, 2001

(86) PCT No.: PCT/GB01/00659

§ 371 (c)(1),
(2), (4) Date: Sep. 23, 2002

(87) PCT Pub. No.: WO01/61656

PCT Pub. Date: Aug. 23, 2001

(65) Prior Publication Data

US 2003/0038015 A1 Feb. 27, 2003

(30) Foreign Application Priority Data

Feb. 17, 2000 (GB) ..... 0003720
Feb. 18, 2000 (GB) ..... 0003915
Feb. 18, 2000 (GB) ..... 0003917

(51) Int. Cl.[7] ..... B07C 5/00; E05G 1/10
(52) U.S. Cl. ..... 209/534; 902/9; 194/215
(58) Field of Search ..... 209/534; 194/206, 194/207, 215, 219, 344, 352, 200, 201, 202, 203, 351; 902/9, 31

(56) References Cited

U.S. PATENT DOCUMENTS

| | | | | |
|---|---|---|---|---|
| 4,653,647 A | | 3/1987 | Hashimoto | |
| 4,693,010 A | | 9/1987 | Sills | |
| 4,830,742 A | * | 5/1989 | Takesako | 209/534 |
| 4,889,220 A | * | 12/1989 | Yoshinori et al. | 194/206 |
| 5,286,017 A | * | 2/1994 | Hawk et al. | 271/303 |
| 5,454,332 A | | 10/1995 | Fennelly et al. | |
| 5,474,289 A | | 12/1995 | Pilling | |
| 5,790,697 A | | 8/1998 | Munro et al. | |

FOREIGN PATENT DOCUMENTS

| | | |
|---|---|---|
| DE | 197 09 458 A1 | 9/1998 |
| WO | WO 82/01698 | 5/1982 |
| WO | WO 98/24069 | 6/1998 |

* cited by examiner

*Primary Examiner*—Donald P Walsh
*Assistant Examiner*—Joseph Rodriguez
(74) *Attorney, Agent, or Firm*—Oliff & Berridge, PLC

(57) ABSTRACT

Document handling apparatus comprises a transport system (2, 3) for feeding documents from an input location (20) to one or more intermediate or final output locations (24, 30), at least one of the output locations being accessable from outside the apparatus. At least one radiation generator (60) and detector (60A) are arranged so as to sense an attempt to access documents in the at least one output location.

18 Claims, 6 Drawing Sheets

DOCUMENT HANDLING APPARATUS AND METHOD

The invention relates to document handling apparatus and a method for handling documents, particularly documents of value such as banknotes.

One common form of document handling apparatus is a document acceptor such as a banknote accepting device. These devices are typically found at banks and occasionally retail locations to enable the user to deposit a sum of money in a secure manner. Often, such deposit devices are incorporated into recirculators which are able to dispense the deposited documents on demand. An example of a typical recirculating device is described in WO-A-98/24069.

Typically, in such deposit devices, the user places the documents to be deposited in an input hopper and these are then transferred while being counted to an escrow location where they are held while the user confirms that the count is correct. Following his confirmation, the documents are then fed on into the machine for secure storage. If the user is unhappy with the count or has changed his mind about making the deposit, the machine will deliver the notes to an output location for removal.

It is important in such deposit machines to ensure that the user is confident that his documents, typically currency, are being handled correctly while at the same time the apparatus must be housed within a secure container so as to prevent the user or other person from removing the documents from the escrow store if not authorised to do so. This could be achieved by incorporating a transparent window into the machine housing but this leads to additional cost in construction of the machine and is undesirable.

In accordance with a first aspect of the present invention, document handling apparatus comprises a transport system for feeding documents from an input location to one or more intermediate or final output locations, at least one of the output locations being accessable from outside the apparatus; and at least one radiation generator and detector arranged so as to sense an attempt to access documents in the at least one output location.

We have devised a new form of document handling apparatus which is both more user friendly than previous apparatus since it enables the documents to be easily viewed and handled by the user, and which achieves the required security. Thus, no physical barrier is employed but rather a non-physical barrier formed by at least one radiation beam which will be broken or otherwise modulated by any attempt to gain access to the at least one output location.

As will be explained in more detail below, the radiation generator and/or detector can be switched between an active and an inactive condition in accordance with operation of the apparatus. Thus, while the apparatus needs to detect unauthorised access, the generator/detector will be active but if the user is entitled to remove the documents then it will be deactivated. Alternatively, they could remain active but the breaking or modulation of the radiation will not cause recovery action by the apparatus.

Typically, for example in the apparatus shown in WO-A-98/24069, at least two output locations are accessible from outside the apparatus. In this case, the first radiation beam generator and detector may be arranged to sense an attempt to access documents in either output location. Alternatively, or in addition, a second radiation generator and detector may be arranged to sense an attempt to access documents in only one of the two output locations.

In some cases, the two output locations may be arranged in parallel but in the preferred examples, they are arranged in series, one or both constituting an escrow store.

In some cases, the radiation generator could generate a radiation field having a nature such that the presence of a modulating influence in the field will be detected.

Alternatively, the generator may generate a radiation beam which extends across the output location(s) concerned. The generator may generate a single beam or multiple beams. Where radiation beam generators are associated with more than one output location, their respective beams may extend transverse, typically orthogonal, to each other.

Conveniently, the radiaton has a wavelength in the invisible range, for example infrared or ultra violet, since this does not obscure the user's view of the documents in the respective output location(s). However, beams with wavelengths in the optical range could also be used.

In accordance with a second aspect of the present invention, a method of operating document handling apparatus comprising a transport system for feeding documents from an input location to one or more intermediate or final output locations, at least one of the output locations being accessable from outside the apparatus; and at least one radiation generator and detector arranged so as to sense an attempt to access documents in the at least one output location; further comprising a document detection system for determining characteristics of documents being transported by the transport system, the transport system being adapted to stop if a document does not satisfy predetermined criteria, comprises i activating the or each radiation beam generator;

ii transporting documents from the input location to said at least one output location;

iii determining characteristics of the documents; and, iv if a document does not satisfy the predetermined criteria, stopping the transport system, and deactivating the radiation beam generator to allow a user to access the document.

An important aspect of document handling apparatus is the need to be able to detect the passage of more than one document simultaneously. If that were to happen, the count would be erroneous which is particularly serious in the case of documents of value such as banknotes. This requires the use of a document thickness detector. Such detectors fall broadly into two categories. The first category involves detecting the opacity of the documents as they pass. If the document appears too opaque then this suggests the passage of more than one document simultaneously. The other category involves monitoring displacement between a pair of feed rollers as the documents are fed by the feed rollers. Examples of this mechanical approach are described in U.S. Pat. No. 5,474,289 and EP-A-0064523.

In this mechanical approach, it is important to detect accurately the relative displacement between the rollers (or other feed surfaces such as belts) and we have therefore devised in accordance with a third aspect of the present invention, a document thickness detector comprising a pair of juxtaposed feed surfaces for movement in a feed direction and between which documents are transported, one of the feed surfaces being mounted on a support such that movement of the one feed surface away from the other feed surface in response to the passage of a document causes corresponding movement of the support; and a support movement detector comprising a cooperating magnet and Hall effect sensor.

The use of a cooperating magnet and Hall effect sensor leads to a very sensitive and accurate means of monitoring displacement between the feed surfaces. Typically, the magnet is mounted to the support and will move relative to an outer support housing but it would also be possible to mount the Hall effect sensor on the support.

An example of a banknote recirculating device according to the present invention will now be described with reference to the accompanying drawings, in which:—

Figure 1:
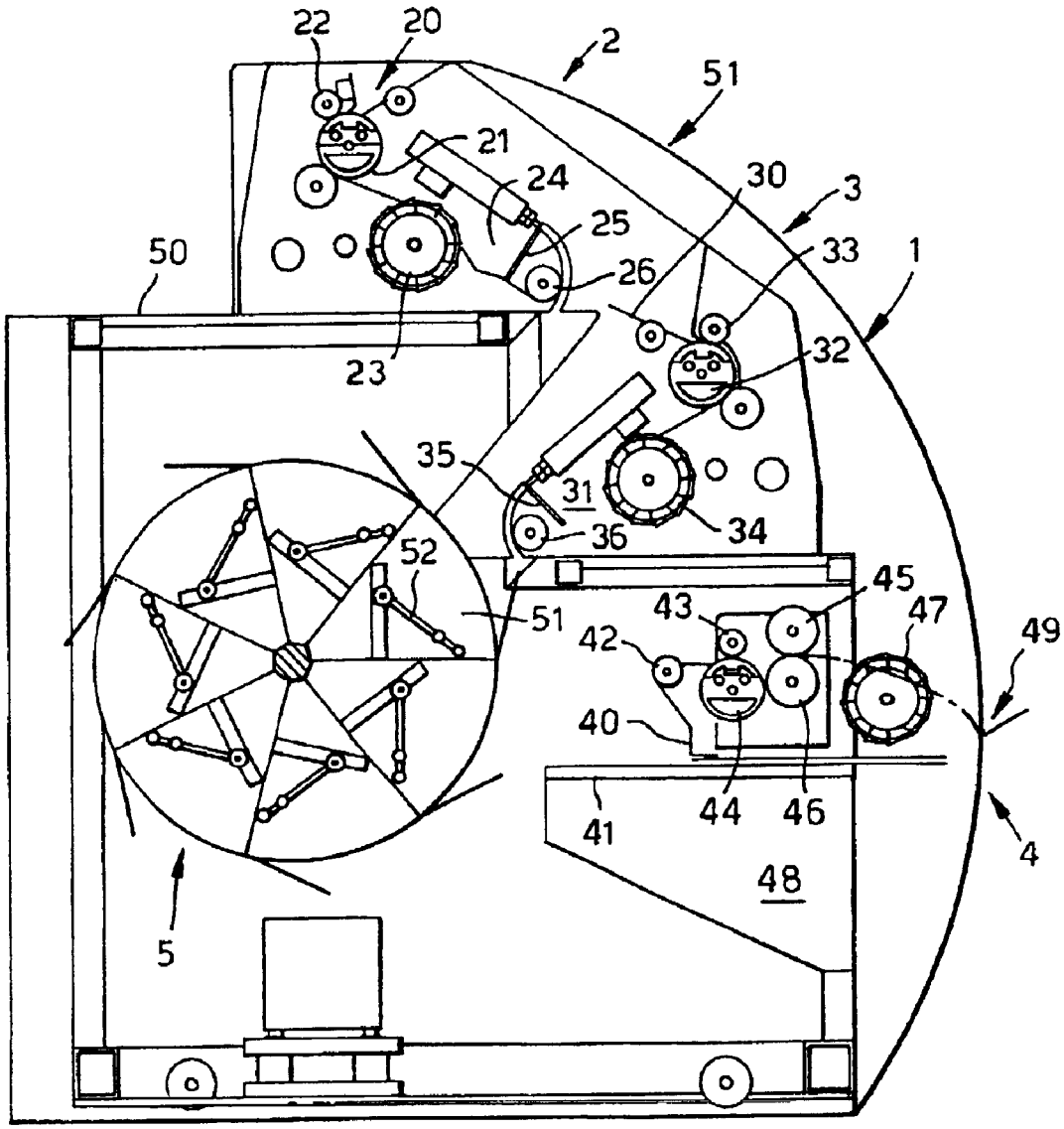
FIG. 1 is a schematic side elevation of the apparatus with several parts omitted for clarity.

The apparatus shown in FIGS. 1 to 5 is substantially the same as that illustrated and described in WO-A-98/24069 and will therefore not be described in detail. The machine 1 comprises three banknote feed modules 2,3,4 and a storage drum assembly 5. Banknotes are initially placed on a feed plate 20A of an input hopper 20 of the upper module 2 from which they are extracted singularly using a separator roller 21 and contra-rotating roller 22, to be guided into stacking wheels 23 which form a stack of the banknotes on a hopper 24 constituting an "output location". As they are fed to the stacking wheels 23, the notes pass UV, IR and note size detectors (not shown), the UV and IR detectors being used to check the authenticity of the notes and the size detector determining the value of the note by reference to the measured long and short edge dimensions in a conventional manner. A control system (not shown) determines from the received information from the detectors whether or not each note is acceptable and its denomination and will then provide on a display (not shown) the total value of the batch counted. If the user indicates that he agrees with the total, a feeder stacker bar 25 is lowered thereby delivering the bundle of notes onto note transport rollers 26 which convey the bundle onto a feed tray 30, constituting a second "output location", of the second feed module 3. The feed tray 30 also acts as a note escrow during problem note recovery.

The motor and drive train (not shown) for the transport rollers is common to the upper and lower feed modules 2,3 and its activation simultaneously operates both sets of rollers.

It should be noted at this point that for large deposits the note feeding stacking and escrow storage operation may be repeated several times in order to effect the movement of all notes from the input feed hopper 20 to the escrow area 30. Such repetition does not require multiple acceptances from the operator, only the total value of the deposit has to be accepted.

Driving the notes into the escrow area 30 (the second feeder area) is achieved by operating the motor for a fixed time period, after which time the top feeder note-stacking bar 25 is raised to its upper position. The stacking wheels 23 are then activated to ensure that no notes remain in the stacker. An optical sensor (not shown) in the hopper 24 is then checked and if any notes are found these are also driven to the escrow area 30 by a repeat of the earlier operations.

All notes for the entire deposit are now in the second feed area 30 and an optical sensor (not shown) in this area will be blocked.

The notes are then fed from the second feed area 30 to a second stacker area 31. The note feed and stacking operations are the same as those described for the upper feed module 2, the module 3 having a stripper roller 32, contra-rotating roller 33 and stacking wheels 34. The second feed module 3 is equipped with a note size detector (not shown) but does not have any authentication devices. The notes are fed until all notes of the same denomination are stacked against a stacking bar 35 each note being checked against long and short edge dimensions by the size detector.

The drum assembly 5 is driven via an encoded control motor and belt (not shown) to position the appropriate pocket 51 facing the stacker area 31. The position of the drum 5 is determined by tracking the encoder pulses with reference to an index position on the drum assembly that can be detected with an optical sensor and flag (not shown). The flag moves with the drum assembly and the sensor is fixed to a supporting chassis (not shown). During the final movements of the drum assembly, a drum pocket clamp control solenoid (not shown) mounted on the drum chassis is activated. The pin of the solenoid engages with a lever mechanism on the side of the drum assembly and this causes a pocket clamp 52 to lift thereby leaving the pocket 51 able to accept notes. The rotation of the drum assembly to achieve the correct position can be achieved in a clockwise or counter-clockwise direction, the direction being chosen to minimise time and motion. To take account of this two solenoids are fitted to the chassis, each of which effects the opening of the clamp and the choice of solenoid being determined by the direction of rotation.

With the drum in position and the pocket clamp open the stacker/delivery bar 35 is moved to its lower position (FIG. 5) by its control motor.

The single denomination bundle of notes is then driven forward into the drum by activating transport rollers 36 via a drive motor (not shown).

After driving the notes forwards into the drum pocket 51 an optical sensor (not shown) is checked to ensure the notes have cleared the drive area.

Once the area is clear the stacker/delivery bar 35 is raised again and the stacker 34 operated to ensure no notes of that denomination remain in the stacker area 31. If any notes are found the previously described delivery operation repeats to place the extra notes in the drum pocket 51.

The process of feeding, stacking and delivering notes one denomination at a time repeats until all notes within the second feed area 31 have been removed to the drum assembly 5. Each separate denomination is stored in a specifically allocated pocket 51 for subsequent re-dispense or in the case of a problem or non-reusable denomination the notes are stored into a mixed note reject pocket.

At any point in the deposit accept cycle a problem with a note can arise. The problem can either be that the note cannot be recognised/denominated by the size detector, or it could fail one of the authenticity checks. The first of these errors can occur in either feed module 2,3 whilst the latter failure can only occur in the upper feed module 2. A not recognised error could be a wrong size or damaged note or a stream/double feed.

Problem Note Recovery in Upper Feed Module 2

When the problem note is detected the note feeding process is suspended and the problem note is held in the stacker wheels 24 such that all previously processed good notes are held on the stacking bar 25. The bar is then lowered and the notes driven into the escrow area 30 and checks are made to ensure that the stacking area is clear. The stacking bar 25 is then raised and the problem note delivered from the stacking wheels into the stacking area 24. The optical sensor in the stacker pocket detects the arrival of the note. The note is now accessible to the operator who can either repair and return it to the feed pocket 20 or in the event of a suspect counterfeit can retain the note for further checking.

Once this is complete the operator must re-start the machine via the host computer to allow the deposit acceptance to continue.

Problem Note Recovery in Lower Feed Module 3

When the problem note is detected the note feeding process is suspended and the problem note is held in the stacker wheels 34 such that all previously processed good notes are held on the stacking bar 25. The bar is then lowered and the notes driven into the appropriate pocket 51 of the drum assembly 5 and checks are made to ensure that the stacking area 31 is clear. The stacking bar 35 is then raised and the problem note delivered from the stacking wheels 34 into the stacking area. The optical sensor in the stacker pocket detects the arrival of the note. The note is now delivered into the reject/mixed note pocket of the drum assembly 5. Once this is complete the machine will continue transferring notes to the other drum pockets 51 and a series of sequence checks are applied to the notes to establish the re-phasing of the remainder of the deposit. The sequence checks are possible since the note sequence will have been established during the first feed cycle in the upper feed module.

For dispensing banknotes, the presenter module 4 is used in conjunction with the drum assembly 5. The presenter module 4 comprises a chassis 40 mounted on slide rails 41 enabling it to slide between its present position shown in FIG. 1, an intermediate reject position (not shown) and an accept position adjacent the drum assembly 5 (also not shown). The presenter module 4 comprises feed rollers 42,43,44 which extract notes from the appropriate pocket 51 and feed them singularly to doubles detect rollers 45,46 and from there either to a stacking wheel 47 or (by means of a diverter not shown) to a reject location 48. Banknotes in the stacking wheel 47 are stacked in an output hopper 49 for collection by the user.

A dispense operation is initiated by a command from the host computer (not shown). The command can either be a manual note mix, i.e. the operator defines the precise mix of notes required or an auto mix wherein the total value of the dispense is defined and the product determines the note mix from the available notes within the drum.

The dispense starts with the presenter module 4 in a known central position.

The drum assembly 5 is then turned to bring the required pocket 51 into a position just short of that required for note removal. This movement is controlled by the encoder signals from the drum motor and can be in either direction. The presenter module 4 is now moved back into the product towards the drum assembly 5 into its note feeding position. This position is determined by an adjustable end stop.

The drum assembly 5 is now moved downwards to its final position. The required number of notes are picked from the drum pocket 51. The pocket note clamp 52 is in the lower clamping position during this to ensure constant pressure between the note pack and the feeder.

Notes are fed from the pocket 51 to the stacker pocket 49 via the doubles detect and a short edge dimension size detector (not shown). The doubles detect is used in conjunction with the size detector to detect any stream fed or overlapped notes.

If a reject event occurs then the feeder is stopped with the note still within the transport. The presenter module 4 is then drawn forward into its mid position and the problem note(s) are reversed out of the presenter into the reject location 48. The size detector is used to verify that the transport is empty. Once this is complete the presenter module 4 returns to allow the appropriate remaining number of notes to be fed.

Repeating the operations of the drum and presenter module collects all the notes required from other pockets 51 to complete the transaction.

With all notes now in stacker pocket 49 the transaction is ready to be presented to the operator. This starts by the opening in the lower part of a cabinet door (not shown) via a motor mounted within the door. A sensor on the door detects the end position for this.

When the cabinet is open the presenter module 4 is driven forward to present the notes to the operator (as shown in FIG. 1).

The operator then removes the notes and when the pocket 49 is sensed as clear it is withdrawn back to the mid-position.

Figure 2:
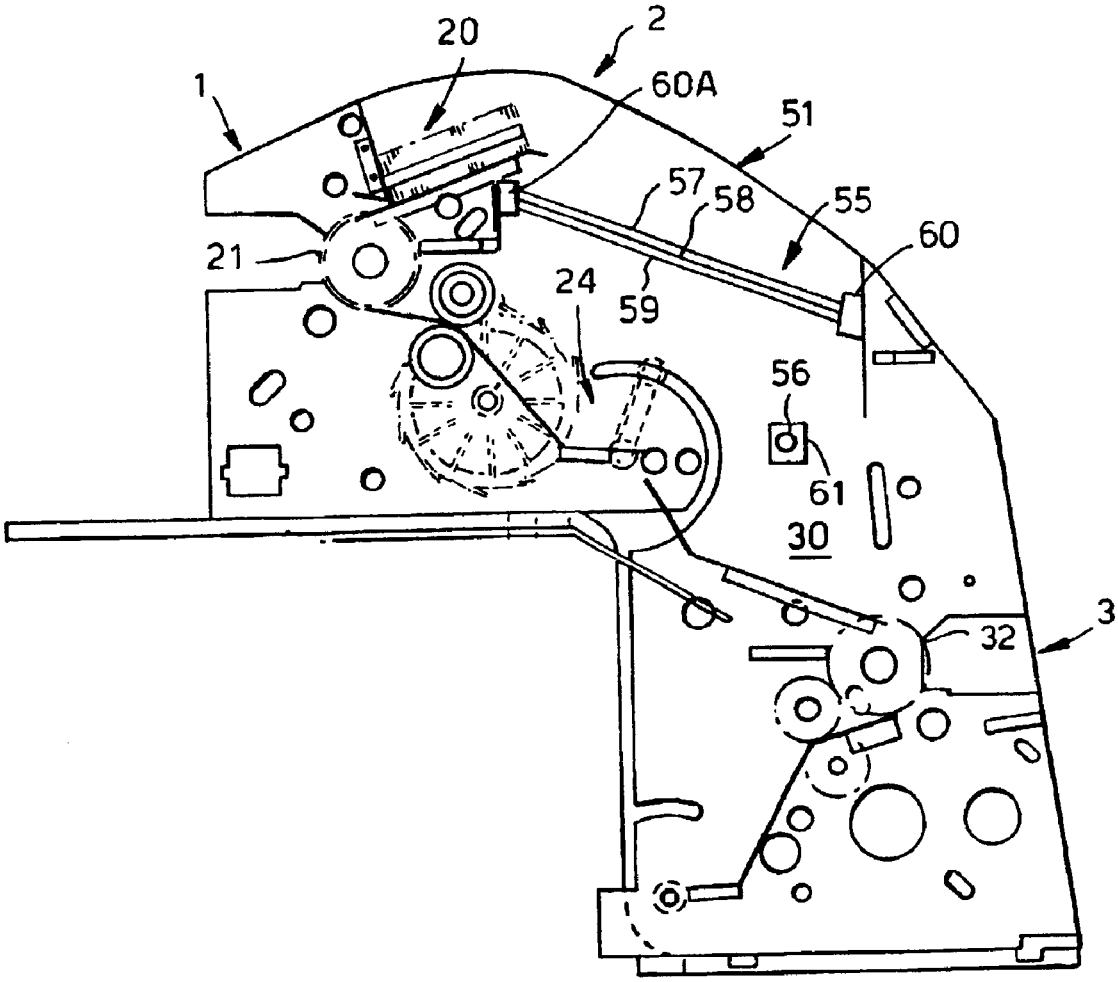
FIG. 2 is a side elevation of part of the apparatus shown in FIG. 1 with some parts omitted and some parts not shown in FIG. 1 included, and illustrating the security barriers in accordance with an example of the present invention.

The apparatus 1 is located within a secure casing 50 but a section of the casing at 51 is omitted so that the stacking areas 24,30 are freely accessible from outside the casing. In order to detect an attempt to access either of the areas 24,30, two optical security screens 55,56 are provided (FIGS. 2 to 5). The upper screen 55 is comprised of three radiation beams 57–59, each generated by a respective LED mounted in a generator housing 60 and being received by a respective photoreceptor mounted in a detector housing 60A. As can be seen in FIG. 2, the beams 57–59 extend across the entire opening presented to the user so that any attempt to gain access to the machine will cause one or more of the beams to be interrupted. The photoreceptors are connected to the main control system to enable it to determine that interruption has occurred.

The lower screen 56 is formed by an LED in a generator housing 61 which generates a radiation beam 62 (FIG. 3) which is received by a photoreceptor 63, the beam 62 being located so as to extend in a direction generally orthogonal to the beams 57–59 and relative to the stacking region 30 so as to detect any attempt to access that region.

Figure 3:
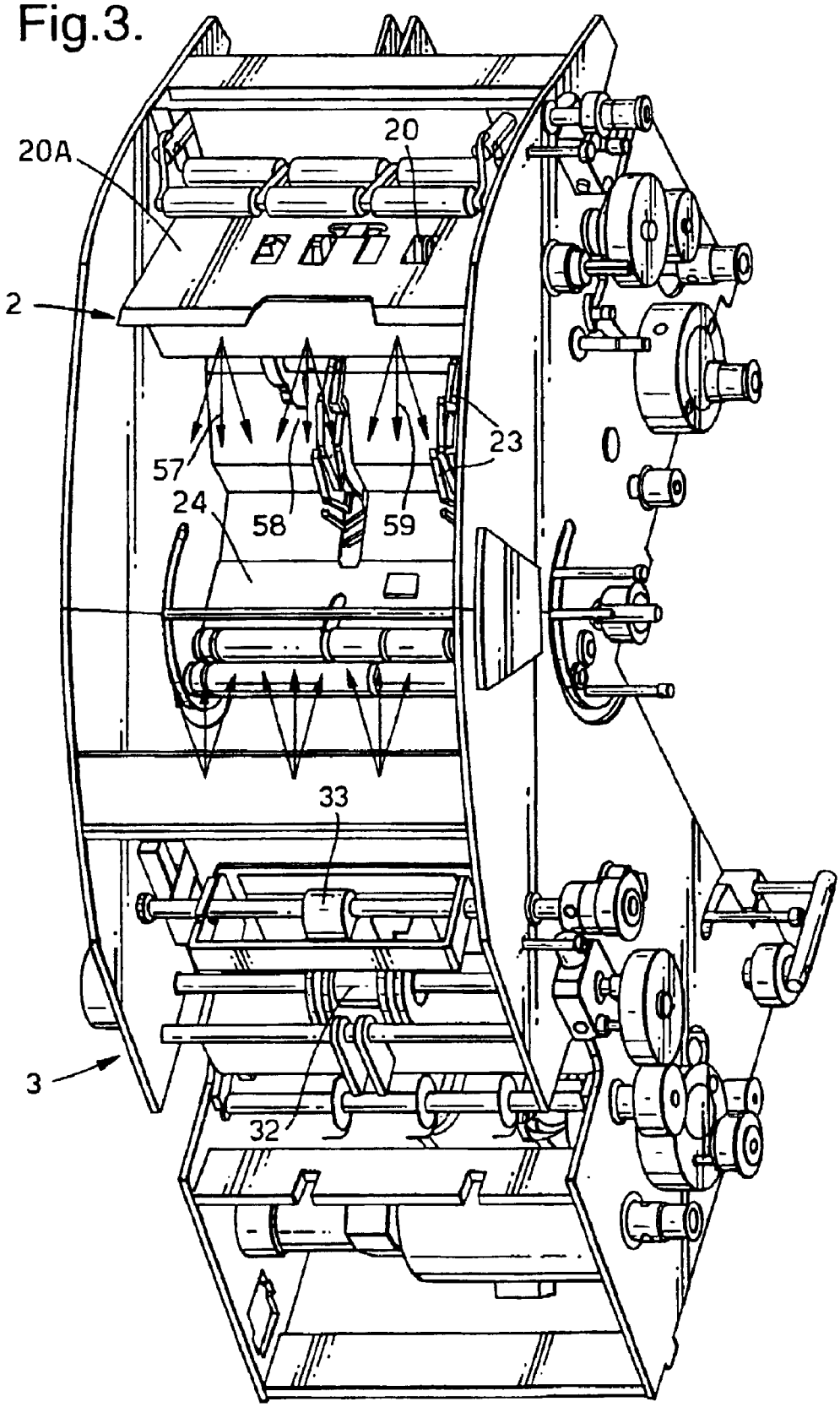
FIG. 3 is a perspective view of the upper and lower feed modules of FIG. 2.
Figure 4:
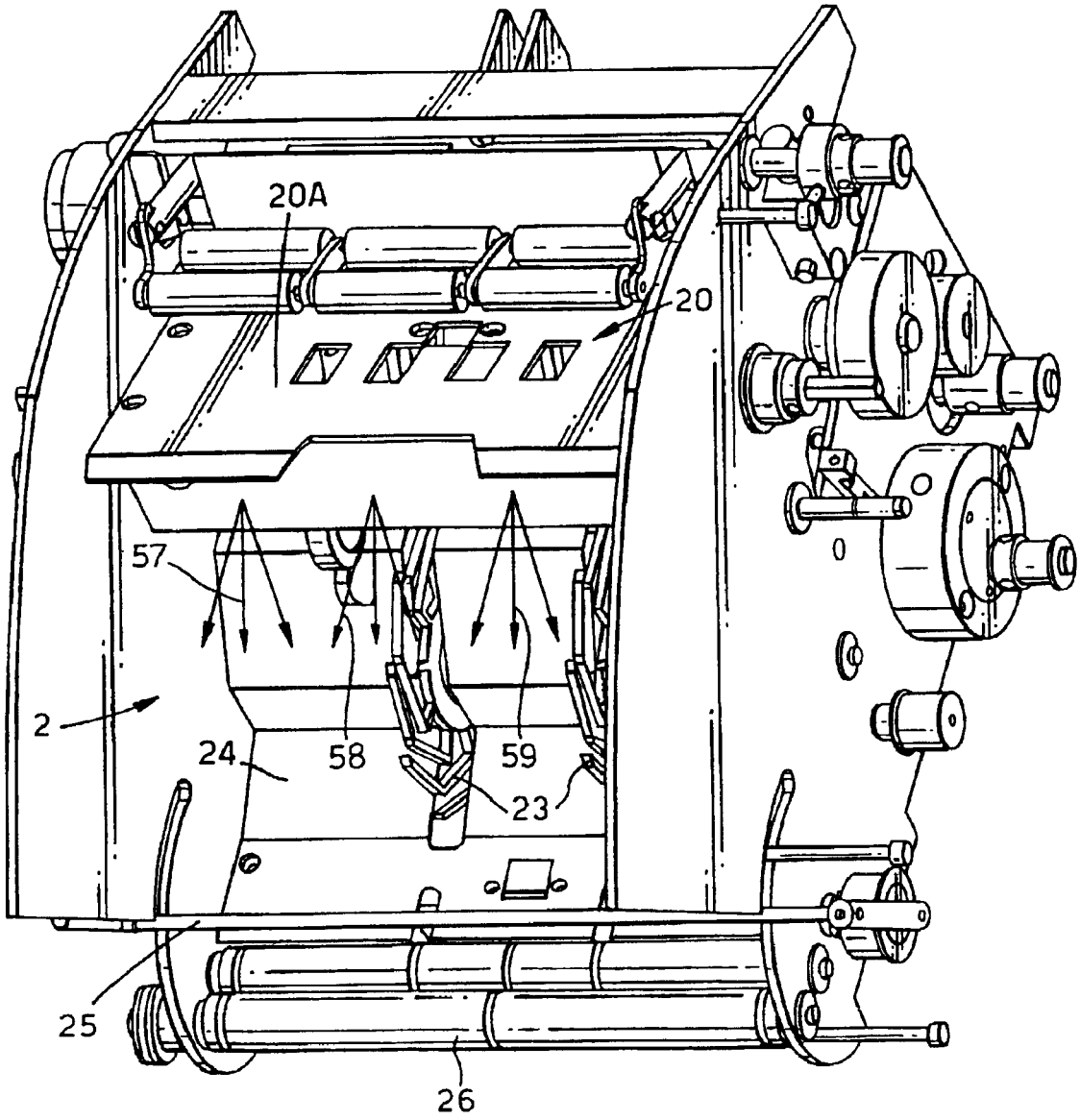
FIG. 4 is a perspective view of the upper feed module.
Figure 5:
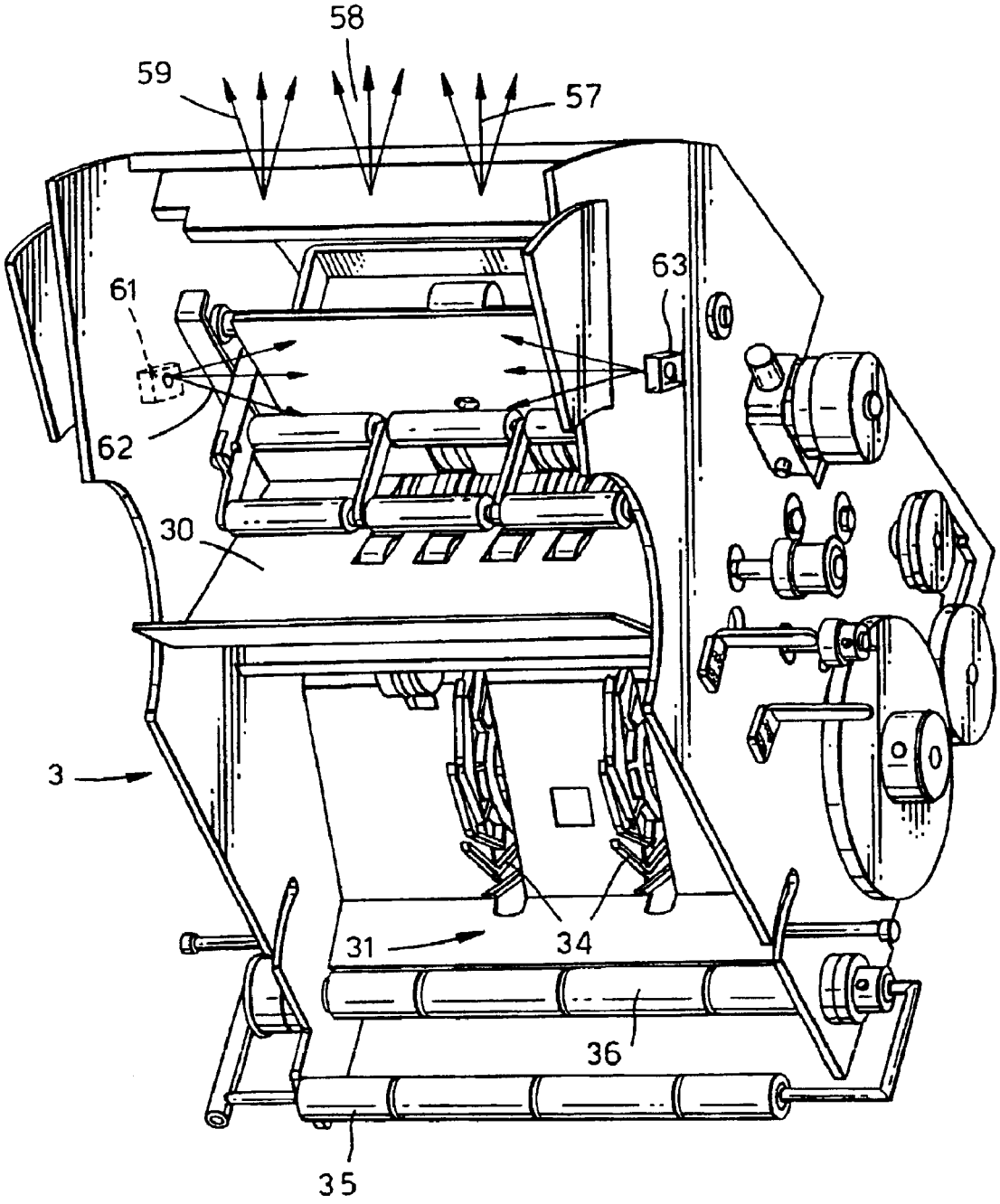
FIG. 5 is a perspective view of the lower feed module.

The generator housings 60,60A,61 and photoreceptor 63 are omitted in FIG. 3.

The optical security screens 55,56 collectively and separately monitor the upper and lower feed areas 24,30 and can detect the unauthorised or untimely entry of foreign objects inclusive of an operator's hand.

During the deposit accept the screens 55,56 are operated as follows:

After the money has been placed in the feeder hopper 20 and before the feeder 21 starts the top screen 55 is enabled and the escrow screen 56 is disabled.

Money is then counted into the stacking area 24.

When a problem note is detected the accepted notes are transferred to the escrow area 30 and the problem note placed into the stacking area 24.

At this time the escrow screen 56 is activated and the top screen 55 de-activated allowing the operator access to the problem note but not the notes in the escrow area 30.

The operator can then resolve the problem note and accept the re-start via the controlling computer.

The control system computer re-engages the top screen 55 and resumes feeding until the transaction is complete.

The escrow screen 56 is de-activated to allow the remaining currency to be transferred to the escrow area 30.

The escrow screen 56 is then re-activated but the top screen 55 left de-activated whilst the notes are transferred to the drum assembly 5.

Any interruption of the top screen 55 at any time will cause the transaction to be cancelled.

Any interruptions to the escrow screen 56 during problem note recovery will cause the transaction to be cancelled.

Any interruption to the escrow screen 56 whilst notes are being transferred to the drum assembly 5 will cause a warning to be issued to the host computer.

The use of the screens 55,56 rather than physical barriers has a number of advantages:

- The screens provide protection without heavy and bulky doors and interlocks that would impede an operator gaining efficient use of the product.
- The elimination of doors and screens leave the notes visible at all times to the operator and the customer. An important part of obtaining acceptance of such products.
- The screens provide machine operator safety interlocks.
- The screens provide a fail-safe, which prevent the machine from operating when it is faulty.

In order to prevent each security screen from being falsely triggered by any transient events a debounce period may be applied to the signals from the screen. For example, the screen will only be triggered if it is interrupted for a period in excess of 0.9 seconds.

Figure 6:
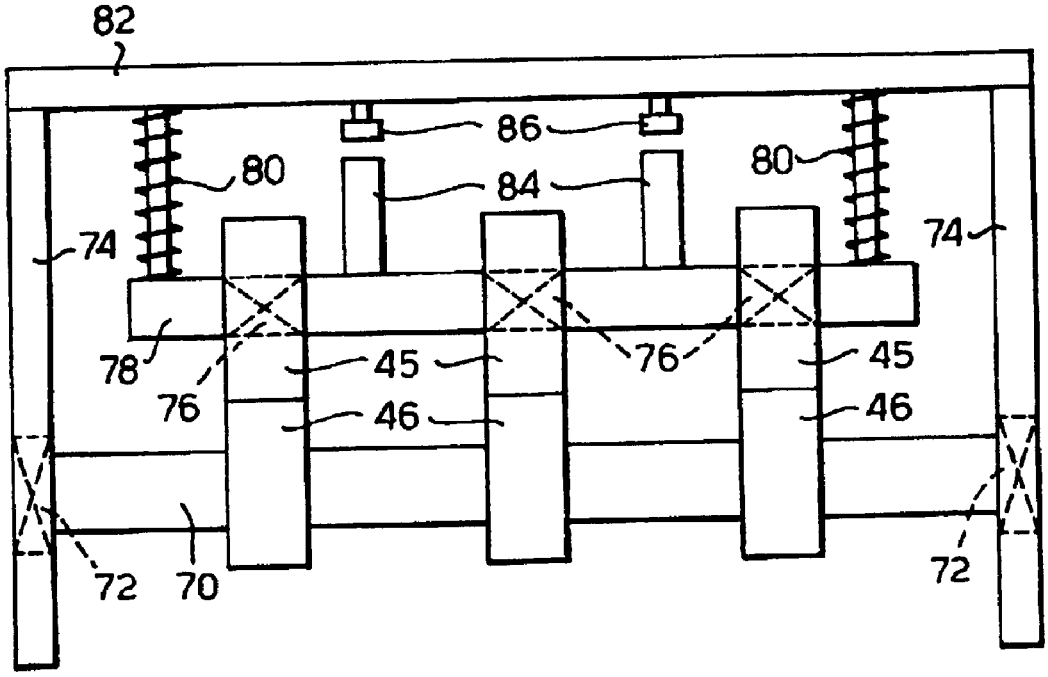
FIG. 6 is an end view of the doubles detect arrangement of the presenter module.

In order to detect the passage of more than one note within the presenter module 4, a doubles detect system is provided shown in more detail in FIG. 6. As can be seen in FIG. 6, three pairs of rollers 45,46 are provided, the rollers 46 being non-rotatably mounted on a shaft 70 journalled in bearings 72 in side walls 74 of the presenter module chassis. The rollers 45 are rotatably mounted via bearings 76 on a shaft 78 suspended via spring mountings shown schematically at 80 from an upper wall 82 of the presenter module chassis. A pair of magnets 84 are supported on the shaft 78 in alignment with respective Hall effect sensors 86 mounted on the wall 82.

As banknotes are conveyed through the presenter module 4, they will reach a doubles detect arrangement and, due to rotation of the shaft 70 and hence rotation of the rollers 46, the banknotes will be carried through the nips defined between the rollers 46 and 45. The thickness of the banknotes will cause the rollers 45 and hence the shaft 78 to deflect upwardly against the spring action of the spring mountings 80 and move the magnets 84 closer to the Hall effect sensors 86. The change in magnetic field experienced by the sensors will result in an appropriate signal being generated which is then passed to the controlling computer system. The deflection is sampled a regular intervals as the note passes through the nips at intervals determined by the encoder on the motor driving the shafts so as to provide a profile of the note for each roller pair. This profile is subtracted from the stored, previously generated profile of the roller pairs in order to determine the thickness profile of the note and any note failing to meet the required thickness criteria for a single note will be rejected.

The beams 57–59 and 62 have a preferred wavelength of 875 nm but many other wavelengths could be used.

What is claimed is:

1. Document handling apparatus comprising a transport system for feeding documents from an input location to one or more intermediate or final output locations, at least one of the output locations being accessible from outside the apparatus via an access opening; and at least one radiation generator and detector arranged to generate a radiation beam extending across said access opening so as to sense an attempt to gain access to documents in the at least one output location.

2. Apparatus according to claim 1, wherein one or more of the at least one radiation generator and detector is switchable between an active and an inactive condition in accordance with operation of the apparatus.

3. Apparatus according to claim 1, wherein at least two output locations are accessible from outside the apparatus, a first of the at least one radiation generator and detector being arranged to sense an attempt to access documents in either output location.

4. Apparatus according to claim 3, further comprising a second radiation generator and detector arranged to sense an attempt to access documents in only one of the two output locations.

5. Apparatus according to claim 4, wherein the second radiation generator generates a radiation beam transverse, preferably orthogonal, to a radiation beam generated by the first radiation generator.

6. Apparatus according to claim 3, wherein one of the output locations is located downstream of the other output location, the transport system being adapted to feed documents from the upstream output location to the downstream output location.

7. Apparatus according to claim 5, wherein one of the output locations is located downstream of the other output location, the transport system being adapted to feed documents from the upstream output location to the downstream output location.

8. Apparatus according to claim 7, wherein the upstream output location is associated with the second radiation generator and detector.

9. Apparatus according to claim 1, where at least one of the radiation generators includes a plurality of subsidiary radiation beam generators.

10. Apparatus according to claim 1, wherein at least one of the radiation generators generates an invisible radiation beam.

11. Apparatus according to claim 1, further comprising a document detection system for determining characteristics of documents being transported by the transport system, the transport system being adapted to stop if a document does not satisfy predetermined criteria.

12. Document handling apparatus according to claim 1, adapted to handle banknotes.

13. Apparatus according to claim 1, wherein at least one of the radiation generators generates a single radiation beam only.

14. A method of operating the document handling apparatus according to claim 11, the method comprising i activating the or each radiation generator;

ii transporting documents from the input location to said at least one of the one or more output locations;

iii determining characteristics of the documents; and, iv if a document does not satisfy the predetermined criteria, stopping the transport system, and deactivating the radiation generator to allow a user to access the document.

15. A method according to claim 14, wherein in step iv prior to deactivating the radiation generator, the method further comprises operating the transport system to feed documents already in said at least one output location to another output location and supplying the unacceptable document to said at least one output location.

16. A method according to claim 15, further comprising a second radiation generator and detector arranged to sense an attempt to access documents in only one of the two output locations, wherein during nonnal operation the second radiation generator is inactive when a first radiation generator is active, while during step iv, the second radiation generator is activated before the first radiation generator is deactivated so as to detect an attempt to access documents in said another output location.

17. A method according to claim 15, wherein one of the output locations is located downstream of the other output location, wherein said at least one output station and said another output location correspond to the upstream and downstream output locations respectively.

18. A method according to claim 14, wherein the documents comprise banknotes.

* * * * *